US005169553A

United States Patent [19]

Durbut et al.

[11] Patent Number: 5,169,553

[45] Date of Patent: Dec. 8, 1992

[54] NONAQUEOUS LIQUID, PHOSPHATE-FREE, IMPROVED AUTOMATIC DISHWASHING COMPOSITION CONTAINING ENZYMES

[75] Inventors: Patrick Durbut, Verviers, Belgium; Fahim Ahmed, Dayton, N.J.; Julien Drapier, Seraing, Belgium

[73] Assignee: Colgate Palmolive Company, New York, N.Y.

[21] Appl. No.: 708,321

[22] Filed: May 31, 1991

[51] Int. Cl.[5] ..... C11D 3/386; C11D 3/37; C11D 3/08; C11D 1/66

[52] U.S. Cl. ..... 252/99; 252/174.12; 252/DIG. 12; 252/DIG. 14

[58] Field of Search ..... 252/174.12, 95, 94, 252/DIG. 12, DIG. 14

[56] References Cited

U.S. PATENT DOCUMENTS

| | | | |
|---|---|---|---|
| 4,162,987 | 7/1979 | Maguire et al. | 252/174.12 |
| 4,501,681 | 2/1985 | Groult et al. | 252/174.12 |
| 4,568,476 | 2/1986 | Kielman et al. | 252/99 |
| 4,753,748 | 6/1988 | Laitem et al. | 252/174.12 |
| 4,810,413 | 3/1989 | Pancheri et al. | 252/DIG. 12 |
| 4,900,475 | 2/1990 | Ramachandran | 252/DIG. 12 |
| 4,931,195 | 6/1990 | Cao | 252/174.12 |

*Primary Examiner*—A. Lionel Clingman
*Assistant Examiner*—Kery A. Fries
*Attorney, Agent, or Firm*—Richard E. Nanfeldt; Robert C. Sullivan; Murray Grill

[57] ABSTRACT

A phosphate-free liquid dishwashing composition containing a binary mixture of a protease enzyme and an amylase enzyme have been found to be very useful. The compositions also contain nonionic surfactants.

17 Claims, No Drawings

NONAQUEOUS LIQUID, PHOSPHATE-FREE, IMPROVED AUTOMATIC DISHWASHING COMPOSITION CONTAINING ENZYMES

FIELD OF THE INVENTION

This invention relates to an improved nonaqueous, phosphate-free, liquid dishwashing detergent for dishwashing machines. More particularly, this invention relates to a concentrated nonaqueous dishwashing composition which contains enzymes and which is phosphate-free.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability is the property whereby the detergent composition containing enzymes does not undergo any significant degradation during storage. This is also known as shelf life. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a suitable environment, the enzymes will suffer a degradation during storage which will result in a product that will have a decreased initial activity. When enzymes are a part of the detergent composition, it has been found that the initial free water content of the composition should be as low a level as possible, and this low water content must be maintained during storage, since water will activate the enzymes. This activation will cause a decrease in the initial activity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied, since there will be a greater volume of air in contact with the detergent, and thus more available moisture to be absorbed by the detergent composition. This will usually accelerate the decrease in the activity of the detergent composition. The most efficient way to prevent a significant decrease in this activity is to start with an initial high activity of enzyme and to use components in the dishwashing composition which have a low hygroscopicity and a low alkalinity which will minimize any losses in activity as the detergent is being stored or used.

The stability of an enzymatic liquid, nonaqueous detergent can be improved by using an alkali metal silicate which has an alkali metal oxide: $SiO_2$ weight ratio greater than 1:1 and of about 1:2 to about 1:3.4. In addition, the individual components of the detergent composition should each have an initial free water content (unbound water at 100° C.) of less than about 10 percent by weight, more preferably less than about 9 percent by weight, and most preferably less than about 8 percent by weight. During manufacture the detergent composition will take-up moisture from the atmosphere. As a result, the moisture content of the detergent composition as it is being packaged will be greater than about 1 percent by weight, preferably less than about 4 percent by weight and most preferably less than about 3 percent by weight.

Nonaqueous liquid dishwasher detergent compositions which contain enzymes can be made more stable and to have a high activity, if the initial free water content of the detergent composition is less than about 6 percent by weight, more preferably less than about 4 percent by weight and most preferably less than about 3 percent by weight. A key aspect is to keep the free water (non-chemically bonded water) in the detergent composition at a minimum. It is critical that water not be added to the composition. Absorbed and adsorbed water are two types of free water, and comprise the usual free water found in a detergent composition. Free water will have the affect of deactivating the enzymes. Furthermore, the pH of a 1.0 wt% aqueous solution of the liquid detergent composition must be less than about 10.5 more preferably less than about 10.2, and most preferably less than about 9.5. This low alkalinity of the dishwashing detergent will also increase the stability of the detergent composition which contains a mixture of enzymes, thereby providing a higher initial activity of the mixture of the enzymes and the maintenance of this initial high activity.

The free water content of the dishwashing detergent composition can be controlled to a large extent by using components that have a low initial water content and a low hygroscopicity. The individual components should have a water content of less than about 10.0 percent by weight, more preferably less than about 9.0 percent by weight, and most preferably less than about 8.0 percent by weight. In addition, the organic components of the dishwashing detergent composition should have low hydroxyl group content to decrease the hydrogen bonding absorption of water. In place of the liquid carrier such as ethylene glycols or glycerols, nonaqueous relatively low hydroxyl content organics such as alcohol ethers and polyalkylene glycols can be used. In place of polyacid suspending agents normally used in liquid automatic dishwashing detergent compositions such as polyacrylic acid or salts of polyacrylic acids, there should be used polyacid/acid anhydride copolymers such as polyacrylic acid/acid anhydride copolymers. Maleic anhydride is a suitable acid anhydride. The net result is a decreased hydroxyl group content which translates to a decreased hygroscopicity of the detergent composition which helps maintain the stability and the activity.

A major concern in the use of automatic dishwashing compositions is the formulation of phosphate-free compositions which are more safe to the environment while maintaining superior cleaning performance and dish care. The present invention teaches the preparation and use of liquid automatic dishwashing compositions which are phosphate-free and have superior cleaning performance and dish care.

SUMMARY OF THE INVENTION

This invention is directed to producing a nonaqueous, phosphate-free, liquid enzyme-containing automatic dishwashing detergent composition that has an increased chemical stability and essentially a constant activity at wash operating temperatures of about 40° C. to 65° C., wherein the composition also can be used as a laundry pre-soaking agent. This is accomplished by controlling the alkalinity and the hygroscopicity of the detergent composition and using a mixture of enzymes. An alkali metal silicate is used in the liquid dishwashing detergent compositions which will have a free water content of less than about 6 percent by weight, more preferably less than about 4 percent by weight, and most preferably less than about 3 percent by weight thought its usage. The $Na_2O:SiO_2$ ratio can exceed 1:3.4 but should not be below about 1:2. The preferred builder system of the instant compositions comprises a mixture of a low molecular weight polyacrylate, sodium citrate and/or sodium carbonate. Furthermore, each of the organic components should have a low hydroxyl group content in order to decrease the potential hydrogen bonding absorption of water in the composition.

Conventional liquid automatic dishwashing compositions usually contain a low foaming surface-active agent, solvent which is usually water, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to, or better than, active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation of the enzyme can occur when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457 to Place et al teaches the use of a proteolytic enzyme having a maximum activity at a pH of 12 in an automatic dishwashing detergent.

U.S. Pat. No. 4,162,987 to Maguire et al teaches a granular or liquid automatic dishwashing detergent which uses a proteolytic enzyme having a maximum activity at a pH of 12 as well as an amylolytic enzyme having a maximum activity at a pH of 8.

U.S. Pat. No. 3,827,938 to Aunstrup et al, discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate an effective bleach-free liquid automatic dishwashing compositions capable of providing superior performance at low alkalinity levels during conventional use.

U.S. Pat. Nos. 3,821,118 and 3,840,480; 4,568,476, 4,501,681 and 4,692,260 teach the use of enzymes in automatic dishwashing detergents, as well as Belgian Patent 895,459; French Patents 2,544,393 and 1,600,256; European Patents 256,679; 266,904; 271,155; 139,329; and 135,226; and Great Britain Patent 2,186,884.

The aforementioned prior art fails to provide a nonaqueous liquid automatic dishwashing detergent which is phosphate-free and contains a mixture of enzymes for the simultaneous degradation of both proteins and starches, wherein the combination of enzymes have a maximum activity at a pH of less than about 9.5 as measured by Anson method and the liquid automatic dishwashing detergent has optimized cleaning performance in a temperature range of about 40° C. to about 65° C.

It is an object of this invention to incorporate an enzyme mixture in a phosphate-free, nonaqueous, dishwasher detergent composition for use in automatic dishwashing operations capable of providing at least equal or better performance at operating temperatures of about 40° C. to about 65° C.

DETAILED DESCRIPTION

The present invention relates to a nonaqueous liquid automatic dishwashing detergent compositions which comprise a nonionic surfactant, a nonaqueous liquid carrier, sodium silicate, a phosphate-free builder system, a stabilizing system, and a mixture of an amylase enzyme and a protease enzyme, wherein the nonaqueous liquid automatic dishwashing detergent composition has a pH of less than 9.5 in the washing liquor at a concentration of 10 grams per liter of water and the nonaqueous liquid dishwashing detergent composition exhibits maximum cleaning efficiency for both proteins and starches at a wash temperature of about 40=C to about 65=C.

The liquid nonionic surfactants that can be used in the present nonaqueous liquid automatic dishwasher detergent compositions are well known. A wide variety of the these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 8 or 5 to 9 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atoms and which contain about 7 ethylene oxide groups per mole.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A(a $C_{13}$–$C_{15}$ fatty alcohol condensed with 6 moles ethylene oxide and 3 moles propylene oxide). Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide). Particularly good surfactants are Plurafac LF132 and LF231 which are capped nonionic surfactants.

Another liquid nonionic surfactant that can be used is sold under the tradename Lutensol SC 9713.

Synperonic nonionic surfactant from ICI such as synperonic LF/D25 are especially preferred nonionic surfactants that can be used in the nonaqueous liquid automatic dishwasher detergent compositions of the instant invention.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The alkylpolysaccharides surfactants which are also useful alone or in conjunction with the aforementioned surfactants and have a hydrophobic group containing from about 8 to about 20 carbon atoms, preferably from about 10 to about 16 carbon atoms, most preferably from 12 to 14 carbon atoms, and polysaccharide hydrophilic group containing from about 1.5 to about 10, preferably from 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkylpolysaccharide surfactants. The number x indicates the number of saccharide units in a particular alkylpolysaccharide surfactant. For a particular alkylpolysaccharide molecule x can only assume integral values. In any physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkylpolysaccharides. When used in admixture with alkylpolysaccharides, the alkylmonosaccharides are solubilized to some extent. The use of alkylmonosaccharides in admixture with alkylpolysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkylpolysaccharides are alkylpolyglucosides having the formula:

$$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol ($R^2OH$) can be reacted with glucose, in the presence of an acid catalyst to form the desired glucoside. Alternatively the alkylpolyglucosides can be prepared by a two step procedure in which a short chain alcohol ($R_1OH$) an be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R^2OH$) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkylmonosaccharide content less than about 10%.

The used herein, "alkylpolysaccharide surfactant" is intended to represent both the preferred glucose and galactose derived surfactants and the less preferred alkylpolysaccharide surfactants. Throughout this specification, "alkylpolyglucoside" is used to include alkylpolyglycosides because the stereo chemistry of the saccharide moiety is changed during the preparation reaction.

An especially preferred APG glycoside surfactant is APG 625 glycoside manufactured by the Henkel Corporation of Ambler, PA. APG 25 is a nonionic alkylpolyglycoside characterized by the formula:

$$C_nH_{2n+1}O(C_6H_{10}O_5)_xH$$

wherein n=10(2%); n=12(65%); n=14(21-28%); n=16(4-8%) and n=18(0.5%) and x(degree of polymerization)=1.6. APG 625 has: a pH of 6-8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5-10 RPM of about 3,000 to about 7,000 cps. Mixtures of two or more of the liquid nonionic surfactants can be used and in some cases advantages can be obtained by the use of such mixtures.

The liquid nonaqueous nonionic surfactant has dispersed therein a builder system which comprises a mixture of phosphate-free particles which is a builder salt and a low molecular weight polyacrylate. A preferred solid builder salt is an alkali metal carbonate such as sodium carbonate or sodium citrate or a mixture of sodium carbonate and sodium citrate. When a mixture of sodium carbonate and sodium citrate is used, a weight ratio of sodium carbonate to sodium citrate is about 9:1 to about 1:9, more preferably about 3:1 to about 1:3.

Other builder salts which can be mixed with the sodium carbonate and/or sodium citrate are gluconates, phosphonates, and nitriloacetic acid salts. In conjunction with the builder salts are optionally used low molecular weight polyacrylates having a molecular weight of about 1,000 to about 100,000, more preferably about 2,000 to about 80,000. Preferred low molecular weight polyacrylate are Sokalan TM CP45 and Sokalan TM CP5 manufactured by BASF and having a molecular weight of about 70,000. Another preferred low molecular weight polyacrylate is Acrysol TM LMW45ND manufactured by Rohm and Haas and having a molecular weight of about 4,500.

Sokalan TM CP45 is a copolymer of a polyacid and an acid anhydride. Such a material should have a water absorption at 38° C. and 78 percent relative humidity of less than about 40 percent and preferably less than about 30 percent. The builder is commercially available under the tradename of Sokalan TM CP45. This is a partially neutralized copolymer of methacrylic acid and maleic acid anhydride sodium salt. Sokalan TM CP5 is the totally neutralized copolymer of methacrylic acid and maleic acid anhydride. Sokolan TM CP45 is classified as a suspending and anti-deposition agent. This suspending agent has a low hygroscopicity as a result of a decreased hydroxyl group content. An objective is to use suspending and anti-redeposition agents that have a low hygroscopicity. Copolymerized polyacids have this property, and particularly when partially neutralized. Acusol TM 640ND provided by Rohm & Haas is another useful suspending and anti-redepositing agent. Another builder is Sokalan TM 9786X which is a copolymer of maleic acid and acrylic acid with a molecular weight of 70,000.

The alkali metal silicates are useful builder salts which also function to make the composition anti-corrosive to eating utensils and to automatic dishwashing machine parts. Sodium silicates of $Na_2O/SiO_2$ ratios of from 1.6/1 to 1:3.4 especially about 1/1 to 1/2.8 are preferred. Potassium silicates of the same ratios can also be used. The preferred alkali metal silicates are sodium disilicate (hydrated), sodium disilicate (anhydrous), sodium metasilicate and mixture thereof, wherein the preferred silicate is hydrated disilicate.

Another class of builders useful herein are the water insoluble aluminosilicates, both of the crystalline and amorphous type. Various crystalline zeolites (i.e. aluminosilicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $(M_2O)_xAl_2O_3)_y(SiO_2)_z\ wH_2O$ wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

The alkali metal silicates are useful anti-corrosion agents which function to make the composition anti-corrosive to eating utensils and to automatic dishwashing machine parts. Sodium silicates of $Na_2O/SiO_2$ ratios of from 1:1 to 1:3.4 especially about 1:2 to 1:3 are preferred. Potassium silicates of the same ratios can also be used. The preferred silicates are sodium disilicate (hydrated or anhydrous) and sodium metasilicate.

The thickening agents that can be used to ensure the physical stability of the suspension and viscosity enhancement are those that will swell and develop thixotropic properties in a nonaqueous environment. These include organic polymeric materials and inorganic and organic modified clays. Essentially, any clay can be used as long as it will swell in a nonaqueous medium and develop thixotropic properties. A preferred clay is bentonite. A swelling agent is used with the bentonite clay. The preferred swelling agent is a combination of propylene carbonate and tripropylene glycol methyl ether. However, any other substance that will cause bentonite to swell in a nonaqueous environment and thus develop thixotropic properties can be used.

Essentially, any compatible anti-foaming agent can be used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silanated silica, trimethysilanated silica and triethylsilanated silica. Suitable anti-foaming agents are Silicone L7604 and TP201 from Union Carbide. Another suitable anti-foaming agent is Silicone DB100 from Dow Corning used at about 0.2 to about 1.0 weight %, sodium stearate used at a concentration level of about 0.5 to 1.0 weight % and LPKN 158 (phosphoric ester) sold by BASF used at a concentration level of about 0 to about 1.5 weight percent, more preferably about 0.2 to about 1.0 weight percent. The perfumes that can be used include lemon perfume and other natural scents. Essentially, any opacifier pigment that is compatible with the remaining components of the detergent formulation can be used. A useful and preferred opacifier is titanium dioxide at a concentration level of about 0 to about 1.5 weight percent.

The nonaqueous liquid carrier materials that can be used for the liquid automatic dishwashing detergent compositions are contained in the composition at a concentration level of at least 40 wt. percent to about 65 wt. percent, more preferably, at least 45 wt. percent to 60 wt. percent, are those that have a low hygroscopicity. These include the higher glycols, polyglycols, polyoxides and glycol ethers. Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (DPMA), ethylene glycol n-butyl ether and ethylene glycol n-propyl ether. A preferred nonaqueous carrier of the instant invention is polyethylene glycol 200 (PEG200) or polyethylene glycol 300 (PEG300).

Other useful solvents are ethylene oxide/propylene oxide, liquid random copolymer such as Synalox solvent series from Dow Chemical (e.g. Synalox 50-50B). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the tradename Dowanol. Also tripropylene glycol mono methyl ether "TPM Dowanol" from Dow Chemical is suitable. Another useful series of solvents are supplied by CGA Biochem, b.v. of Holland such as Plurasolv ®ML, Plurasolv ®EL(s), Plurasolv ®EL, Plurasolv ®IPL and Plurasolv ®BL.

Mixtures of PEG solvent with Synalox or PnB, DPnB, TPnB and TPM solvents are also useful . Preferred mixtures are PEG 300/Synalox 50-50B and PEG 300/TPnB in weight ratios of about 95:5 to 20:80, more preferably of about 90:10 to 50:50. EP/PO capped nonionic surfactants can be used as a liquid solvent carrier and an example of such a nonionic surfactant is Plurafac LF/132 sold by BASF.

The system used in the instant compositions to ensure phase stability (stabilizing system) comprises a finely divided silica such as Cab-o-Sil M5, Cab-o-Sil EH5, Cab-o-Sil TS720 or Aerosil 200 which are used at a concentration level of about 0 to about 4.0 weight percent, more preferably about 0.5 to about 3.0 weight%. Also employed as a stabilizing system are mixtures of finely divided silica such as Cab-o-Sil and nonionic associative thickeners such as Dapral T210, T212 (Akzo) which are low molecular weight dialkyl polyglycol ethers with a dumbbell-like structure or Pluracol TH 916 and TH 922 (BASF) associative thickeners having star-like structure with a hydrophilic core and hydrophobic tail. These thickeners are used at concentration levels of about 0 to about 5.0 weight percent together with about 0 to about 2.0 weight percent of finely divided silica. Another useful stabilizing system are blends of organoclay gel and hydroxypropyl cellulose polymer (HPC). A suitable organoclay is Bentone NL27 sold by NL Chemical. A suitable cellulose polymer is Klucel M cellulose having a molecular weight of about 1,000,000 and is sold by Aqualon Company. Bentone gel contains 9 percent Bentone NL 27 powder (100 percent active), 88 percent TPM solvent (tripropylene glycol mono methyl ether) and 3 percent propylene carbonate (polar additive). The organic modified clay thickener gels are used at concentration levels of about 0.0 weight percent to about 1.5 weight percent in conjunction with Klucel M at concentration levels of about 0 to about 0.6 weight percent, more preferably about 0.2 weight percent to about 0.4 weight percent. Another useful thickening agent is a high molecular weight long chain alcohol such as Unilin TM 425 sold by Petrolite Corp.

The detergent composition of the present invention can possibly include a peroxygen bleaching agent at a concentration level of about 1 to about 15 wt. percent. The oxygen bleaching agents that can be used are alkali metal perborate, percarbonate, perphthalic acid, and potassium monopersulfate. A preferred compound is sodium perborate monohydrate. The peroxygen bleaching compound is preferably used in admixture with an activator thereof. Suitable activators are those disclosed in U.S. Pat. No. 4,264,466 or in column 1 of U.S. Pat.

No. 4,430,244, both of which are herein incorporated by reference. Polyacrylated compounds are preferred activators. Suitable preferred activators are tetraacetyl ethylene diamine ("TAED"), pentaacetyl glucose and ethylidene benzoate acetate.

The activator which is present at a concentration of about 0.5 to about 5.0 wt. percent usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Suitable sequestering agents include the sodium salts of nitroilotriacetic acid (NA), ethylene diamine tetraacetic acid (EDTA), diethylene triamine pentaacetic acid (DETPA), diethylene triamine pentamethylene phosphonic acid (DTPMP) sold under the tradename DEQUEST 2066 and ethylene diamine tetramethylene phosphoric acid (EDITEMPA).The sequestering agents can be used alone or in an admixture.

The detergent formulation also contains a mixture of a proteolytic enzyme and an amylotytic enzyme and optionally, a lipolytic enzyme that serves to attack and remove organic residues on glasses, plates, pots, pans and eating utensils. Proteolytic enzymes attack protein residues, lipolytic enzymes fat residues and amylolytic enzymes starches. Proteolytic enzymes include the protease enzymes subtilism, bromelin, papain, trypsin and pepsin. Amylolytic enzymes include amylase enzymes. Lipolytic enzymes include the lipase enzymes. The preferred amylase enzyme is available under the name Maxamyl, derived from Bacillus licheniformis and is available from Gist-Brocades of the Netherlands in the form of a nonaqueous slurry (18 wt. % of enzyme) having an activity of about 40,000 TAU/g. The preferred protease enzyme is available under the name Maxacal derived from Bacillus alcalophilus, and is supplied by Gist-Brocades, of the Netherlands in a nonaqeous slurry activity of about 1,000,000 ADU/g. Preferred enzyme activities per wash are Maxacal-420-840 KDU per wash and Maxamyl-4,000-8,000 TAU per wash.

The weight ratio of the slurry of the proteolytic enzyme to the amylolytic in the nonaqueous liquid automatic dishwasher detergent compositions is about 6:1 to about 1:1, and more preferably about 5:1 to about 1.1:1.

The detergent composition can have a fairly wide ranging composition. The surfactant can comprise about 0 to 15 percent by weight of the composition, more preferably about 2 to 15 percent by weight, and most preferably about 4 to about 12 percent by weight. The anti-foaming agent will be present in an amount of about 0 to about 1.5 percent by weight, more preferably about 0.1 to about 1.2 percent by weight and most preferably about 0.3 to about 1 percent by weight. The builder system, which is preferably sodium citrate, and more preferably sodium carbonate or a mixture of sodium carbonate and sodium citrate in a weight ratio of about 9:1 to about 1:9, more preferably about 3:1 to about 1:3, is present in an amount of about 2 to about 25 percent by weight, more preferably about 4 to about 20 percent by weight and most preferably about 5 to about 18 percent by weight in the detergent composition. The builder system also preferably contains the low molecular weight noncrosslinked polyacrylate type polymer at a concentration level of about 0 to about 25 weight percent, more preferably 1.0 to about 20 weight percent and most preferably about 2 to about 15 weight percent.

The thickener that can be used to provide phase stability to the detergent composition is preferably a bentonite clay gel which is a mixture of propylene carbonate and tripropylene glycol monomethyl ether (TPM) and Bentone NL27. It is present in an amount of about 0 to about 15 percent by weight, more preferably about 5 to about 12 percent by weight and most preferably about 7 to about 10 percent by weight. Propylene carbonate in the gel will be present in an amount of about 2 to about 4 percent by weight, and the TPM is present at about 80 to 90 weight percent. Also one can employ a bentonite clay gel/hydroxypropyl cellulose polymer.

The alkali silicate, which is a corrosion inhibitor, wherein sodium disilicate (hydrated) is preferred, will be present in an amount of about 0 to 20 percent by weight, more preferably about 3 to about 15 percent by weight and most preferably about 6 to about 12 percent by weight.

The opacifier pigment will be present in an amount of about 0 to about 1.0 percent by weight, more preferably about 0.1 to about 1.0 percent by weight and most preferably about 0.4 percent by weight. The preferred stabilizing system are Cab-o-Sil M5 and Cab-o-Sil EH5 which are present at a preferred concentration of about 0 to about 3.0 weight percent, more preferably about 0.1 to about 3.0 weight percent, and most preferably about 0.3 to about 2.5 weight percent.

The enzymes will be present in an amount in slurry form (about 18 wt % enzyme powder in PEG 400/PEG 4000 liquid carrier) of about 0.8 to 16.0 percent by weight, more preferably about 0.9 to 14.0 percent by weight, and most preferably about 1.0 to about 12.0 percent by weight. The protease enzyme slurry will be comprised in the automatic dishwashing composition at about 0.5 to about 12.0 percent by weight, more preferably at about 0.7 to about 10.0 weight percent and most preferably at about 0.8 to about 8.0 percent by weight. The amylase enzyme will be comprised about 0.3 to about 6.0 percent by weight, more preferably about 0.4 percent to about 3.0 weight percent and most preferably about 0.5 to about 2.0 weight percent. The lipase enzyme will be comprised at about 0 to about 8.0 percent by weight of the detergent composition. A suitable lipase is Lipolase 100 SL from Novo Corporation. Another useful lipase enzyme is Amano PS lipase provided by Amano International Enzyme Co, Inc. The lipase enzymes are especially beneficial in reducing grease residues and related filming problems on glasses and dishware.

Other components such as perfumes and color will be comprised at about 0.0 to about 1.0 percent by weight of the detergent composition. The remainder of the detergent composition will be comprised of the nonaqueous carrier. This will range from about 15 to about 65 weight percent, more preferably about 25 to 57 weight percent, and most preferably about 40 to about 55 weight percent.

The detergent formulation is produced by combining the liquid components consisting of the carrier, surfactant and anti-foam agent and then adding the builder salt, suspending and anti-redeposition agent (copolymerized polyacrylic acid) and alkali metal silicate. This mixture is then ground in a ball mill to a particle size of less than about 10 microns, and preferably to a size of about 4 to 5 microns. The enzyme mixture is then added. The enzymes preferably will be in a polyethylene glycol slurry. This enzyme mixture is mixed into the ground slurry. Then the thickener, phase stabilizing system, opacifiers, brighteners and perfumes are added. After a thorough mixing, the detergent composition is packaged.

The concentrated nonaqueous liquid nonionic automatic dishwashing detergent compositions of the present invention dispenses readily in the water in the dishwashing machine. The presently used home dishwashing machines have a measured capacity for about 40 cc to about 60 cc or about 40 grams to about 80 grams of detergent. In normal use, for example, for a full load of dirty dishes 45 grams of powdered detergent are normally used.

In accordance with the present invention only about 20 cc to about 35 cc of the concentrated liquid nonionic detergent composition is needed. The normal operation of an automatic dishwashing machine can involve the following steps or cycles: washing, rinse cycles with cold water and rinse cycles with hot water. The entire wash and rinse cycles require about 80–90 minutes. The temperature of the wash water in European dishwashers is about 50° C. to 65° C., depending on the chosen washing program, and the temperature of the rinse water is about 65° C., whatever the performed dishwashing program.

The highly concentrated nonaqueous liquid automatic dishwashing detergent compositions exhibit excellent cleaning properties for protein residues such as egg and starchy carbohydrates residues such as oatmeal and minimizes the formation of spots and film on the dishware and glassware.

In an embodiment of the invention, the phase stability of the builder salts, the polyacrylate type polymer and the alkali metal silicate in the composition during storage and the dispersibility of the composition in water is improved by grinding and reducing the particle size of the solid ingredients to less than 100 microns, preferably less than 40 microns and more preferably to less than about 10 microns. The solid builders are generally supplied in particle sizes of about 100, 200 or 400 microns. The nonionic liquid surfactant phase can be possibly mixed with the solid builders prior to carrying out the grinding operation.

In the grinding operation it is preferred that the proportion of solid ingredients be high enough (e.g. at least about 40%, such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements give very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed e.g. a CoBall mill or a Netzsch ball mill may be employed. When using such a mill, it is desirable to pass the blend of nonionic surfactant and solids first through a mill which does not effect such fine grinding (e.g. to about 40 microns) prior to the step of grinding to an average particle diameter below about 10 microns in the continuous ball mill.

In a preferred embodiment the detergent builder particles have a particle size distribution such that no more than 10% by weight of said particles have a particle size of more than about 10 microns.

It is also contemplated within the scope of this invention to form compositions without grinding, wherein the particle size has a distribution of about 60–120 microns.

DESCRIPTION OF THE PREFERRED EMBODIMENTS

EXAMPLE 1

The concentrated nonaqueous liquid nonionic surfactant detergent compositions were formulated from the following ingredients in the amounts specified.

| | A | B | C | D | E | F | G | H | I | J | K | L | M | N | O | P |
|---|---|---|---|---|---|---|---|---|---|---|---|---|---|---|---|---|
| PEG 300 | Bal. | Bal. | Bal. | Bal. | Bal. | Bal. | Bal. | Bal. | Bal. | Bal. | Bal. | Bal. | Bal. | 55.2 | 30.7 | — |
| SYNALOX 50-50B | — | — | — | — | — | — | — | 6.0 | 6.0 | — | — | — | — | 6.1 | 25.6 | Bal. |
| SYNPERONIC LFD25 | 8 | 8 | 8 | 8 | 8 | 8 | — | 3.0 | 3.0 | 4.0 | 8 | 8 | 3 | 3 | — | — |
| PLUROFAC LF132 | — | — | — | — | — | — | 8.0 | — | — | — | — | — | — | — | 8 | 8 |
| SILICONE DB100 | 0.5 | 0.5 | 0.5 | 0.5 | 0.5 | 0.5 | — | — | — | 0.2 | 0.5 | 0.5 | — | — | — | — |
| SODIUM DISILICATE (Anhydrous) | 9.0 | 9.0 | 9.0 | 9.0 | 9.0 | 9.0 | 9.0 | 9.0 | 9.0 | 9.0 | 9.0 | 9.0 | 9.0 | 9.0 | 9.0 | 9.0 |
| SODIUM DISILICATE (hydrated) | — | — | — | — | — | — | — | — | — | — | — | — | — | — | — | — |
| SODIUM CARBONATE | 12.5 | 10.0 | 15.0 | 12.5 | 12.5 | 12.5 | 12.5 | — | 7.5 | 12.0 | 7.5 | 17.0 | 12.5 | 12.5 | 12.5 | 12.5 |
| SODIUM CITRATE | — | — | — | — | — | — | — | 14.5 | 7.5 | 12.5 | 7.5 | — | — | — | — | — |
| SOKALAN CP45 | 7.5 | 10.0 | 5.0 | 15.0 | — | 7.5 | 7.5 | 7.5 | 7.5 | 7.5 | 15.0 | 10.0 | 7.5 | 7.5 | 7.5 | 7.5 |
| ACRYSOL LMW 45ND | — | — | — | — | 15.0 | — | — | — | — | — | — | — | — | — | — | — |
| ACUSOL 640ND | — | — | — | — | — | — | — | — | — | — | — | — | — | — | — | — |
| MAXACAL PROTEASE (Activity 1,000,000 ADU/g | 3.5 | 3.5 | 3.5 | 3.5 | 3.5 | 3.5 | 3.5 | 3.5 | 3.5 | 3.5 | 3.5 | 3.5 | 3.5 | 3.5 | 3.5 | 3.5 |
| MAXAMYL AMYLASE (Activity 40,000 TAU/g) | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 |
| $TiO_2$ | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 |
| CABOSIL M5 | 2.0 | 2.0 | 2.0 | 2.0 | 2.0 | 2.0 | 2.0 | 2.0 | 2.0 | 2.0 | 2.0 | 1.0 | 2.0 | 2.0 | 2.0 | 1.5 |
| DAPRAL T270 | — | — | — | — | — | 5.0 | 5.0 | — | — | — | — | — | 5.0 | — | — | — |
| PHYSICAL STABILITY - Phase separation in height % | 894 | | | | | +685 | 704 | 809 | | 908 | | 904 | 808 | 799 | 790 | 792 |
| RT | 2% 12 W | | | | | 1% 12 W | 0% 12 W | 1.5% 12 W | | 0% 12 W | | 6% 12 W | 1% 12 W | 1% 12 W | 0% 12 W | 0% 12 W |

-continued

| | A | B | C | D | E | F | G | H | I | J | K | L | M | N | O | P |
|---|---|---|---|---|---|---|---|---|---|---|---|---|---|---|---|---|
| 4° C. | 3% 12 W | | | | | — | — | 1% 12 W | | 0% 12 W | | 4% 12 W | 0% 12 W | 1% 12 W | 1% 12 W | 1% 12 W |
| 35° C. | 2% 12 W | | | | | — | — | 1.5% 12 W | | 0% 12 W | | 5% 12 W | 0% 12 W | 0% 12 W | 0% 12 W | 0% 12 W |

Laboratory performance of the compositions of the example were carried out under European cleaning conditions in a Bauknecht machine which has a built-in heater and water softening ion-exchange resin at a temperature range of about 50° C. to about 65° C. with 3 ml of a rinse aid (Galaxy Rinse Aid) used in the later stages of the cycle (automatically dispensed during the rinse cycle). Egg soil was prepared by mixing egg yolk with an equal amount of 2.5N calcium chloride solution. 0.4 grams of this mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. 3 grams of this mixture was spread as thin film onto a 7.5 inch china plate. The plates were aged for 2 hours at 80° C. They were then stored overnight at room temperature. Six plates of each egg and oatmeal were used per wash. The plates were placed in the same positions in the dishwasher. Twenty five grams of the detergent was used as a single dose per wash. All plates were scored by measuring the percent area cleaned. The multi-soil cleaning test results are reported below. The results tabulated were average of at least 4 runs.

| | DW | T° | WATER HARDNESS SOFT/HARD | A | B | C | D | E | F | G | H | I | J | K |
|---|---|---|---|---|---|---|---|---|---|---|---|---|---|---|
| GREASY BUILD-UP TEST | Bauknecht | 65° C. | X | 897 | — | — | 892 | — | 764 | 755 | 877 | | 908 | 888 |
| Glasses (0–10 Scale) | | | | | | | | | | | | | | |
| GENERAL | | | | 7.2 | — | — | 7.3 | — | 6.7 | 7.3 | 7.3 | | 7.2 | 7.3 |
| FILMING | | | | 7.3 | — | — | 7.5 | — | 6.8 | 7.5 | 6.7 | | 7.2 | 7.5 |
| SPOTTING | | | | 7.0 | — | — | 7.5 | — | 7.2 | 8.5 | 9.2 | | 7.8 | 7.3 |
| PLASTIC TILES WEIGHT INDEX | | | | 17.0 | — | — | 15.0 | — | 9.0 | 27.0 | 13.0 | | 11.0 | 15.0 |
| pH | | | | 8.9 | — | — | — | — | — | — | 7.3 | | — | — |
| SOIL CLEANING TEST | Bauknecht | 55° C. | X | | | | | | | | 021 | — | — | — |
| OATMEAL | | | | 10.0 | | | 10.0 | 10.0 | — | — | — | — | — | — |
| $CaCl_2$ EGGS | | | | 9.9 | — | — | 9.9 | 9.9 | — | — | — | — | — | — |
| MICROWAVE EGGS | | | | 7.2 | — | — | 6.3 | 6.5 | — | — | — | — | — | — |
| GLASSES (0–10 Scale) | | | | | | | | | | | | — | — | — |
| GLASSES - GENERAL | | | | 4.8 | — | — | 3.7 | 5.4 | — | — | — | — | — | — |
| FILMING | | | | 7.2 | — | — | 7.3 | 7.4 | — | — | — | — | — | — |
| SPOTTING | | | | 4.9 | — | — | 3.6 | 5.1 | — | — | — | — | — | — |
| pH | | | | 9.7 | — | — | 9.4 | 10.1 | — | — | — | — | — | — |
| MULTISOIL CLEANING TEST | Bosch | 50° C. | X | 867 | (b) | (b) | 868 | 869 | | | 844 | 846 | | |
| GLASSES (0–10 Scale) | | | | 5.4 | 6.1 | 7.2 | 5.0 | 4.7 | — | — | 5.1 | 5.4 | — | — |
| PORRIDGE-CUTLERY | | | | 10.0 | 7.0 | 7.8 | 9.8 | 10.0 | — | — | 9.3 | 9.8 | — | — |
| RICE & CHEESE-CUTLERY | | | | 10.0 | 9.5 | 10.0 | 10.0 | 10.0 | — | — | 9.3 | 9.8 | — | — |
| RICE-CUTLERY | | | | 10.0 | 10.0 | 10.0 | 10.0 | 10.0 | — | — | 9.8 | 10.0 | — | — |
| WHITE SAUCE-DISHES | | | | 9.5 | 6.0 | 5.8 | 8.0 | 7.3 | — | — | 9.8 | 9.5 | — | — |
| RICE-DISHES | | | | 9.8 | 10.0 | 10.0 | 10.0 | 10.0 | — | — | 9.3 | 9.8 | — | — |
| PORRIDGE-PLATES | | | | 10.0 | 8.5 | 8.8 | 10.0 | 10.0 | — | — | 10.0 | 10.0 | — | — |
| EGGS-PLATES | | | | 9.0 | — | — | 8.9 | 9.4 | — | — | 8.9 | 9.4 | — | — |
| MEAN CLEANING | | | | 9.2 | 8.6 | 8.8 | 9.0 | 8.9 | — | — | 8.9 | 9.2 | — | — |
| GLASSES (0–4 Scale) | | | | | | | | | | | | | | |
| NO FILMING | | | | 1.8 | 2.0 | 1.8 | 2.3 | 2.3 | — | — | 1.7 | 2.2 | — | — |
| NO SPOTTING | | | | 2.8 | 2.2 | 2.8 | 3.0 | 3.0 | — | — | 2.1 | 2.1 | — | — |
| NO REDEPOSITION | | | | 3.9 | 2.4 | 2.7 | 4.0 | 4.0 | — | — | 4.0 | 4.0 | — | — |
| GLOBAL | | | | 2.8 | 2.2 | 2.5 | 3.1 | 3.1 | — | — | 2.6 | 2.7 | — | — |
| (a) PHILIPS | D.W. 55° C. | | | | | | | | | | | | | |
| (b) BAUKNECHT | D.W. 55° C. | | | | | | | | | | | | | |

The above described examples of illustrative compositions of the invention were evaluated for performance according to the following laboratory test methods.

All cleaning performance were carried out under European washing conditions in automatic dishwashers with a built-in heater and water softening ion-exchange resin, at a temperature range of about 50° C. to about 65° C. with 3 ml of a rinse aid (Galaxy Rinse Aid) used in the later stages of the cycle (automatically dispersed by a built-in closing device during the last rinse cycle). Twenty-five grams of the illustrative compositions were used as a simple dose per wash.

In the so-called soil-cleaning test four sets of plates were identically soiled with food (oatmeal soil, hardened egg soil and microwave oven-cooked egg soil). Oatmeal soil was prepared by boiling 24 grams of Quaker Oats in 400 ml of tap water for ten minutes and then homogenized with a high shearing device (Ultrawax). 3 grams of this mixture were spread as thin film onto 7.5 inch china plates. The plates were aged for 2 hours at 80° C., and then stored overnight at room temperature. Hardened egg soil was prepared by mixing egg yolk with an equal amount of 2.5N calcium chloride solution. 0.4 grams of this mixture was applied as a thin crosswise film to the usable surface of 7.5 inch china plates. Microwave egg soil was prepared by mixing hot egg yolk and cooked margarine with an homogenizer (Ultraturax device). 5 grams of this mixture were spread as thin film onto 7.5 inch china plates, and the soiled plates were based afterwards for one minute in a microwave oven. The two type of egg soils were stored overnight at room temperature. Six plates of oatmeal and three plates of each egg were used per wash, together with six clean glasses. The twelve soiled plates and the six glasses were always placed in the same positions in the dishwasher at each run. In each test four different compositions were assessed according to a Latin Square procedure using a series of four dishwashers. Cleaning performance results for each composition are average of the four runs conducted in the four dishwashers.

All washed plates were scored each run by determining the percent area cleaned (percentage of soil removal) with the aid of a reference scale of gradually cleaned plates. Average percentages of soil removal for each type of soil after four runs were converted in a 0 to 10 scale, 0 being for no soil removal and 10 for perfect cleaning. Glasses were rated in a viewing box for global aspect and filming and spotting performance, also according to a scale ranging from 0 (bad performance) to 10 (perfectly clean glasses) with the aid of reference glasses.

In the multisoil cleaning test different dishware/soil combinations were used. The dishwasher load included each run six plates of oatmeal, three plates of hardened egg, three plates of microwave-egg, one dish of white sauce, one dish of rice, four glasses soiled with tomato juice four glasses soiled with tomato juice, four glasses soiled with cocoa and four soiled with milk. Pieces of cutlery (forks, knives and spoons, six each) were also included and soiled with porridge soil, rice and rice with cheese soils.

Same Latin Square procedure was used as for soil cleaning test. Percentages of soil removal on all the dishware and glasses were converted in 0 to 10 scale, 0 being for no soil removal and 10 for perfect cleaning. Glasses were also scored for filming, spotting and redeposition of soils, according to a 0 (bad performance) to 4 (very good performance) scale with the aid of reference glasses. A different scale was used to distinguish the data from soil removal performance. Results tabulated were average of four runs.

In the greasy residue build-up test, the dishwasher load included six clean plates in the lower basket, six clean glasses in the upper basket and sixteen plastic tiles in the cutlery basket. The soil load was consisting of 50 g of a greasy soil mixture prepared by mixing mustard (42 weight %) white vinegar (33 wt. %), corn oil (15 wt. %) and lard (10 wt. %) altogether.

Up to twelve cumulated runs were conducted for each tested composition using a series of four dishwashers in which four different compositions were assessed at the same time. The test method consisted of a combination of three Latin Squares procedures, so that each composition was used twelve times, with three rotations of the four detergent compositions in the four dishwashers. 50 grams of greasy soil mixture were poured each run in the wash bath together with twenty-five grams of the detergent composition used as a single dose per wash.

After each run, the upper basket containing the six glasses, the cutlery basket with the plastic tiles as well as the dishwasher filter elements were moved from one dishwasher to the following one, before conducting the next run. Such a procedure was used to assess the performance of compositions on glasses and on plastic dishware surfaces under conditions of repeated washer in the presence of said greasy soil mixture.

After each series of four repeated runs, glasses were scored in a viewing box for global aspect, and filming and spotting performance according to the same 0 (bad performance) to 10 (perfectly clean glasses) scale as for the so-called soil cleaning test with the aid of reference glasses. Also plastic tiles were weighted after a series of four runs. A greasy build-up index was determined for each tested composition according to the equation $[(P2-P1)/P1]\times 10{,}000$ with P1 being the weight of the sixteen clean plastic tiles and P2 the final weight of the sixteen tiles after four runs.

The same procedure was repeated three times using the same set of glasses and same set of plastic tiles so as to calculate average performance results for each composition after series of respectively four, eight and twelve sums. The dishwashers filter parts were also inspected after four, eight and twelve runs to evidence greasy deposit build-up differences between compositions.

The physical stability of typical compositions was assessed by measuring the phase separation between the liquid phase and the solid dispersed phase that occurred on opening respectively at room temperature, 4° C. and 35° C. The degree of phase separation at the different temperatures was expressed as height percentage of the total product as measured in appropriate tubes containing about 100 grams of composition, after a given period of time.

What is claimed is:

1. A phosphate free, liquid dishwashing composition comprising by weight;

(a) 2 to 12% of a liquid nonionic surfactant;
(b) 40 to 60% of a nonaqueous liquid carrier material;
(c) 2 to 25% of an alkali metal carbonate;
(d) 0 to 25% of an alkali metal citrate;
(e) 0 to 1.5% of an anti foaming agent;
(f) 0.5 to 12% of a protease enzyme;
(g) 0.3 to 6.0% of an amylase enzyme;
(h) 0 to 20% of a low molecular weight polyacrylate polymer;
(i) 3.0 to 20% of an alkali metal silicate; and
(j) 0.5 to 4.0% of a finely divided silica stabilizing system, wherein a 1.0 wt. % solution of said composition has a pH of less that about 9.5 and said composition contains less than 6 weight percent of water.

2. A method of cleaning dishes, glasses, cups and eating utensils in an automatic dishwashing machine at a wash temperature of about 40° C. to about 65° C. which comprises adding to the wash water in said dishwashing compositions which comprises by weight;

(a) 2 to 12% of a liquid nonionic surfactant;
(b) 40% to 60% of a non aqueous liquid carrier material;
(c) 2 to 25% of an alkali metal citrate;
(d) 0 to 25% of an alkali metal citrate;
(e) 0 to 1.5% of an antifoaming agent;

(f) 0.5 to 12% of a protease enzyme;
(g) 0.3 to 6.0% of an amylase enzyme;
(h) 0 to 20% of a low molecular weight polyacrylate polymer;
(i) 3 to 20% of alkali metal silicate; and
(j) 0.5 to 4.0% of a finely divided silica stabilizing system, wherein a 1.0 wt. % solution of the composition has a pH of less than about 9.5 and said composition contains less than 6 weight percent of water.

3. A method according to claim 2 wherein said dishwashing composition contains in slurry form about 0.5 to 12.0 percent by weight of said protease enzyme and about 0.3 to 6.0 percent by weight of said amylase enzyme.

4. A method according to claim 2 wherein said dishwashing composition further contains a lipase enzyme.

5. The method according to claim 2 wherein said dishwashing composition includes about 0 to 8.0 weight percent of a lipase enzyme.

6. The method according to claim 2 wherein said dishwashing composition contains an alkali metal borate bleachant.

7. The method according to claim 10 wherein said dishwashing composition contains a bleachant activator.

8. The method according to claim 2 wherein said dishwashing composition includes about 0.1 to 1.2 percent by weight of an anti-foaming agent and about 3.0 to about 20.0% sodium silicate.

9. The method according to claim 2, wherein a weight ratio of the protease enzyme to the amylase enzyme is about 6:1 to about 1:1.

10. A method according to claim 2 wherein said protease enzyme is Maxacal protease enzyme and said amylase enzyme is Maxamyl amylase enzyme and the pH of the detergent dishwashing composition (1% aqueous solution) is less than 10.2 and the detergent dishwashing composition is used at a wash temperature of about 40° C. to about 65° C.

11. The method according to claim 2 further includes a nonionic associative thickener.

12. The nonaqueous liquid dishwashing composition according to claim 1 wherein said dishwashing composition contains in slurry form about 0.5 to 12.0 percent by weight of said protease enzyme and about 0.3 to 6.0 weight percent of said amylase enzyme.

13. The nonaqueous liquid dishwashing composition according to claim 1 which contains an alkali metal borate.

14. The nonaqueous liquid dishwashing composition according to claim 13 which contains an alkali metal borate activator.

15. The nonaqueous liquid dishwashing composition according to claim 1 which contains a lipase enzyme.

16. The nonaqueous liquid dishwashing composition according to claim 1 which includes about 0.1 to 1.2 percent by weight of an anti-foaming agent.

17. The nonaqueous liquid dishwashing composition according to claim 1, wherein said protease enzyme is Maxacal Protease enzyme and said amylase enzyme is Maxamyl amylase enzyme, a weight ratio of said protease enzyme to said amylase enzyme being about 6:1 to about 1:1, wherein said detergent dishwashing composition (1% aqueous solution) has a pH of less than 10.2.

* * * * *